US007634980B2

(12) United States Patent
Jarnland et al.

(10) Patent No.: US 7,634,980 B2
(45) Date of Patent: Dec. 22, 2009

(54) CRANKCASE SCAVENGED TWO-STROKE INTERNAL COMBUSTION ENGINE HAVING AN ADDITIONAL AIR SUPPLY

(75) Inventors: Per-Arne Jarnland, Huskvarna (SE); Stefan Steen, Huskvarna (SE); Joel Berneklev, Hisings Backa (SE)

(73) Assignee: Husqvarna AB, Huskvarna (SE)

( * ) Notice: Subject to any disclaimer, the term of this patent is extended or adjusted under 35 U.S.C. 154(b) by 310 days.

(21) Appl. No.: 11/571,779

(22) PCT Filed: Jul. 16, 2004

(86) PCT No.: PCT/SE2004/001137

§ 371 (c)(1),
(2), (4) Date: Feb. 16, 2007

(87) PCT Pub. No.: WO2006/009494

PCT Pub. Date: Jan. 26, 2006

(65) Prior Publication Data

US 2008/0302345 A1 Dec. 11, 2008

(51) Int. Cl.
*F02B 25/00* (2006.01)
*F02B 33/04* (2006.01)

(52) U.S. Cl. ..... 123/73 R; 123/73 AA; 123/73 PP

(58) Field of Classification Search ..... 123/73 R, 123/73 AA, 73 PP
See application file for complete search history.

(56) References Cited

U.S. PATENT DOCUMENTS

| | | | | |
|---|---|---|---|---|
| 6,895,910 | B2 * | 5/2005 | Geyer et al. | 123/73 PP |
| 6,945,203 | B2 * | 9/2005 | Amend et al. | 123/73 PP |
| 2002/0043227 | A1 * | 4/2002 | Carlsson et al. | 123/73 PP |
| 2002/0112681 | A1 | 8/2002 | Rosskamp et al. | |
| 2003/0029398 | A1 * | 2/2003 | Andersson et al. | 123/73 PP |
| 2003/0217710 | A1 | 11/2003 | Geyer et al. | |

FOREIGN PATENT DOCUMENTS

| | | |
|---|---|---|
| EP | 1 006 267 A1 | 6/2000 |
| SE | 513466 C2 | 9/2000 |

* cited by examiner

*Primary Examiner*—Noah Kamen
(74) *Attorney, Agent, or Firm*—Pearne & Gordon LLP

(57) ABSTRACT

A crankcase scavenged two-stroke internal combustion engine (1) having an additional air supply (2) arranged to its transfer ducts (3), connecting a crankcase volume (4) and a transfer port (5). There is at least one recess (6, 24) in a piston (7) arranged below a piston ring (10, 11), and further there is a flow channel (12; 13; 14) arranged in the piston or in a cylinder wall (29) of the engine cylinder (9), and the recess is arranged to register with the transfer port and the flow channel for certain first piston positions, i.e. to create a communication between the transfer port/s and the crankcase volume.

11 Claims, 3 Drawing Sheets

CRANKCASE SCAVENGED TWO-STROKE INTERNAL COMBUSTION ENGINE HAVING AN ADDITIONAL AIR SUPPLY

TECHNICAL FIELD

The subject invention refers to a crankcase scavenged two-stroke internal combustion engine, having an additional air supply arranged to its transfer ducts, connecting a crankcase volume and a transfer port. The engine is primarily intended for a hand-held working tool.

BACKGROUND OF THE INVENTION

A difficulty regarding crankcase-scavenged engines is to provide a homogeneous air-fuel mixture to the combustion chamber, especially if the engine is provided with additional air supply to the transfer ducts. A homogenous mixture can be achieved by so called long transfer ducts, which however tends to make the crankcase complicated and bulky. For two-stroke engines provided with additional air to the transfer ducts it is important to keep the air in the transfer ducts separated from the air-fuel mixture, in order to as far as possible prevent the air-fuel mixture from the transfer ducts to disappear out through the exhaust port. This separation, also called stratification, is often promoted by making the transfer ducts long and narrow, thus preventing, or at least reducing, mixing of different scavenging gases. The length is also adapted to the desired performance of the tool and its engine. Long transfer ducts for high torque at low speed and shorter ducts for high torque at high speed.

However, there is a tendency that speed dependent pressure variations are created in the transfer ducts of the engine during operation. These pressure variations are caused by oscillation of the gases contained in the transfer ducts. These pressure variations are particularly big for long and narrow transfer ducts, but they can also be fairly big also for short and narrow transfer ducts. These pressure variations change with the speed of the engine. When opening the supply of additional air to the transfer ducts at different speeds this would lead to reduced feed of air at some speeds and increased air feed at other speeds. Therefore the operation of the engine is not as good as intended. The variations in the amount of supplied additional air to the transfer ducts leads to a variation with speed in the overall air fuel ratio of the engine, and is therefore a problem.

SUMMARY OF THE INVENTION

The purpose of the subject invention is to take away or at least reduce the above outlined disadvantages.

This purpose is achieved in a crankcase scavenged combustion engine of the initially mentioned kind, wherein there is at least one recess in a piston arranged below a piston ring, and further there is a flow channel arranged in the piston or in a cylinder wall of the engine cylinder, and the recess is arranged to register with the transfer port and the flow channel for certain piston positions, i.e. to create a communication between the transfer port/s and the crankcase volume. This design has a number of advantages. The flow channel will connect the transfer port with the crankcase volume. This will take away pressure fluctuations in the transfer duct. At the same time or preferably thereafter the transfer port will be connected to an additional air supply. Due to this design the pressure in the top part of the transfer duct will be the same as in the crankcase volume for all engine speeds. Therefore the fill of additional air to the transfer ducts will vary considerably less, giving an increased performance of the engine.

BRIEF DESCRIPTION OF THE DRAWINGS

The invention will be described in the following with reference to the accompanying drawing figures, which in the purpose of exemplifying are showing preferred embodiments of the invention.

DETAILED DESCRIPTION OF PREFERRED EMBODIMENTS

Figure 1:
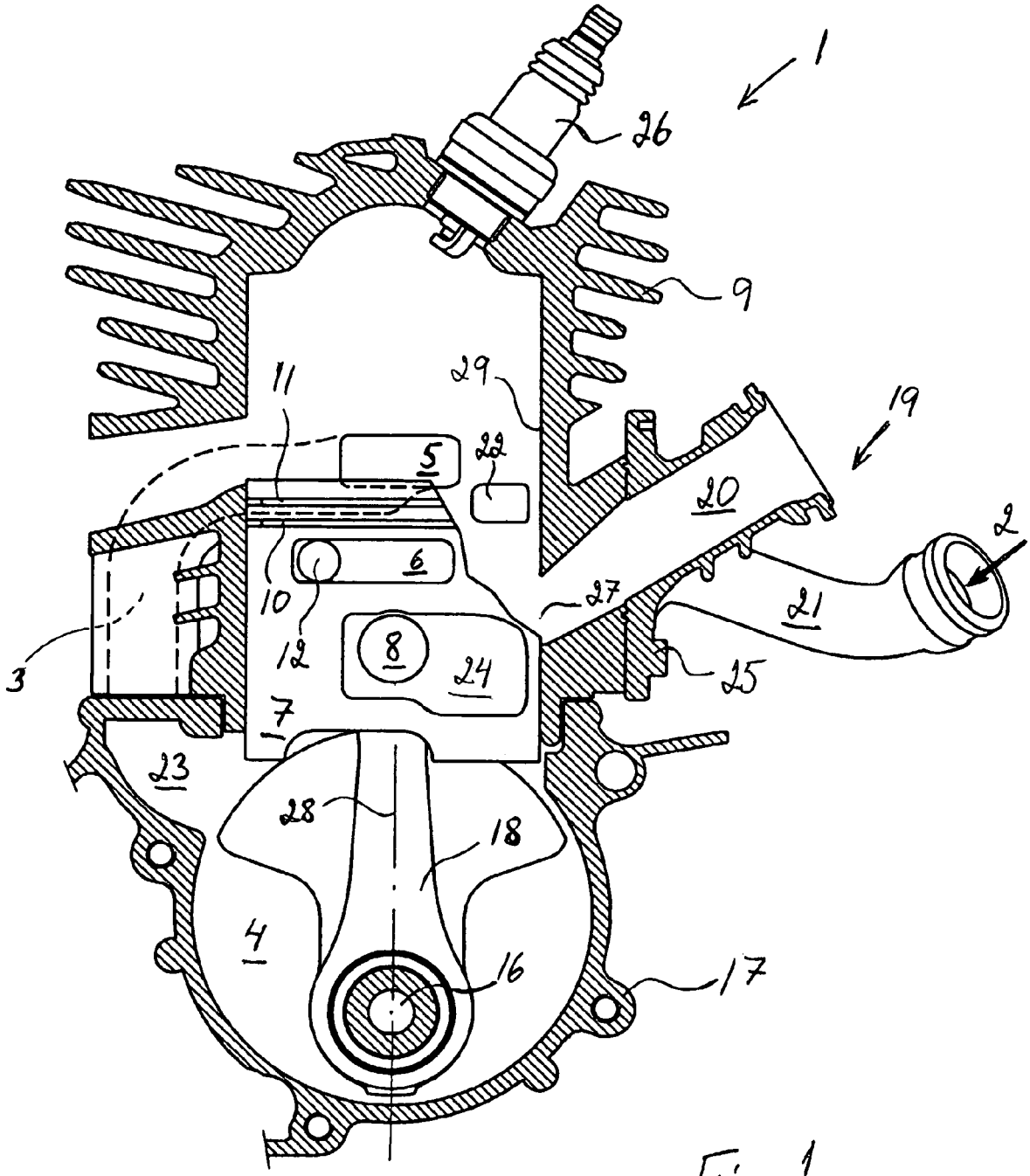
FIG. 1 illustrates schematically in a side view the engine of a first embodiment. The engine cylinder and crankcase are shown in a cross-sectional view while the piston is only shown in a side view and with a partial cut-away.

With reference to FIG. 1 an engine according to a first embodiment of the invention is shown. For clarity reasons the cylinder 9 and crankcase 17 is shown in a longitudinal cross-section, but the piston 7 is shown in a side view. This makes it easier to see a number of recesses in the piston. Also the piston is partially cut away to make all ports in the cylinder wall visible. This engine has two transfer ducts 3, but only one is visible, but could also have three, four or five or possibly one. This means that the recesses shown in the piston cooperate with ports above the plane of the paper while recesses on the not visible backside of the piston cooperate with the shown ports. The engine 1 has a cylinder 9 with cylinder bore having a cylinder wall 29. A piston 7 is intended to be movable in the cylinder bore. The piston is connected to a crankshaft 16 via a piston rod 18. The cylinder is attached to a crankcase 17. The underside of the piston 7 and the crankcase 17 forms a crankcase volume 4 that will vary when the piston moves up and down. At least one transfer duct 3 connects the crankcase volume with a transfer port 5, here the transfer duct 3 starts in a first part 23 in the crankcase.

An intake duct 20 is attached to the engine cylinder as well as an air duct 21 for feeding additional air 2. The two ducts 20, 21 are integrated into a common intake system 19 having a baffle 25 that is fastened to the cylinder. Further there is a spark plug 26. The intake duct 20 leads from a fuel supply unit, e.g. a carburetor (not shown) and to an intake port 27 in the cylinder wall 14. Therefore a mixture of air and fuel will be sucked down into the crankcase volume through the intake port 27 when the piston has risen above the intake port 27. Additional air 2 is supplied through air duct 21 to air supply port 22. When a second recess 24 in the piston will register with air supply port 22 and transfer port 5 air will be sucked down into the transfer ducts 3. Air will fill the transfer duct almost completely. This is a normal operation for a piston-ported crankcase scavenged two-stroke engine with additional air.

Figure 2:
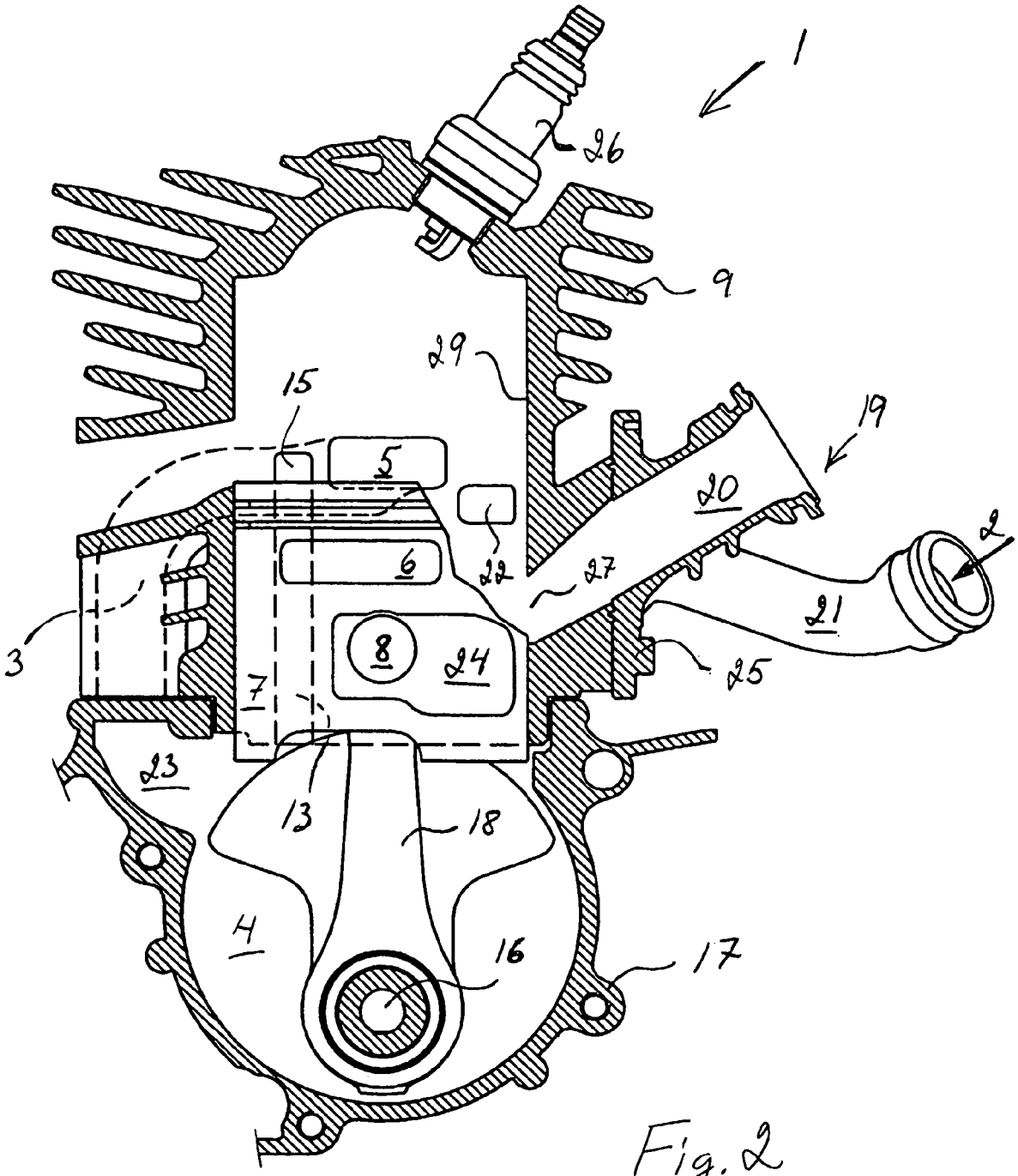
FIG. 2 illustrates schematically a second embodiment of the engine according to the invention and also in a partial cross-section.
Figure 3:
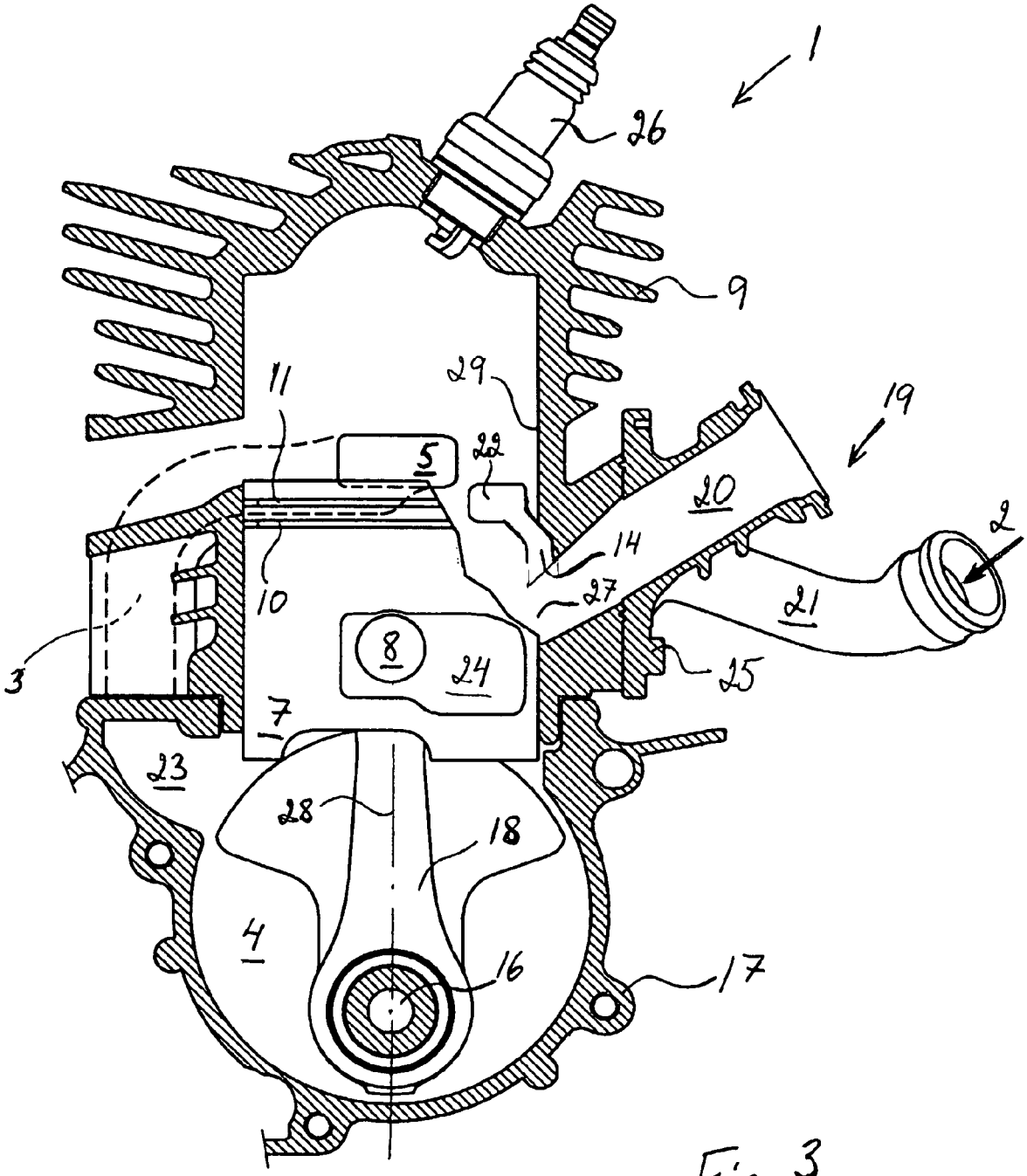
FIG. 3 illustrates schematically a third embodiment of the engine according to the invention and also in a partial cross-section.
Figure 1:
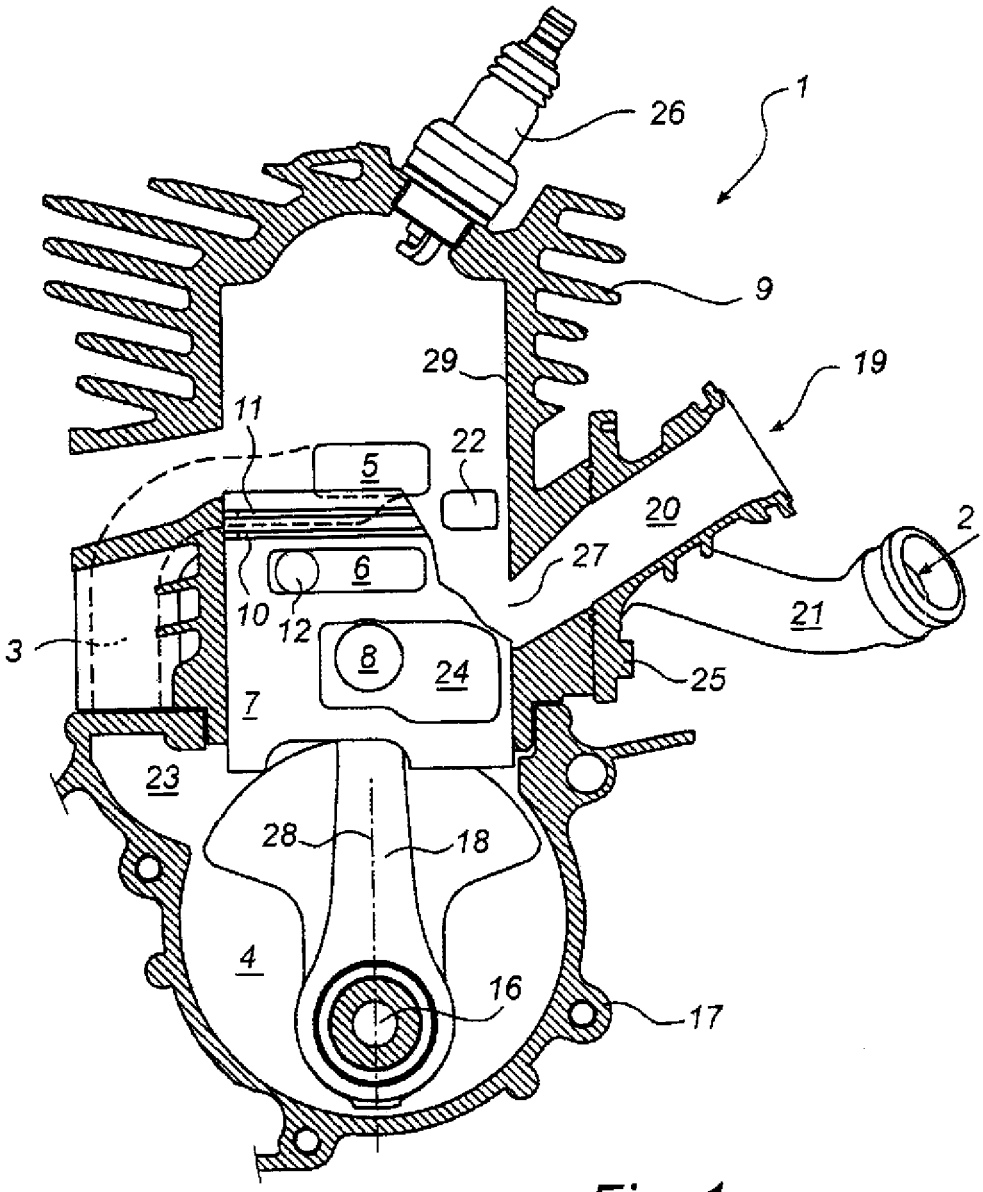
Figure 2:
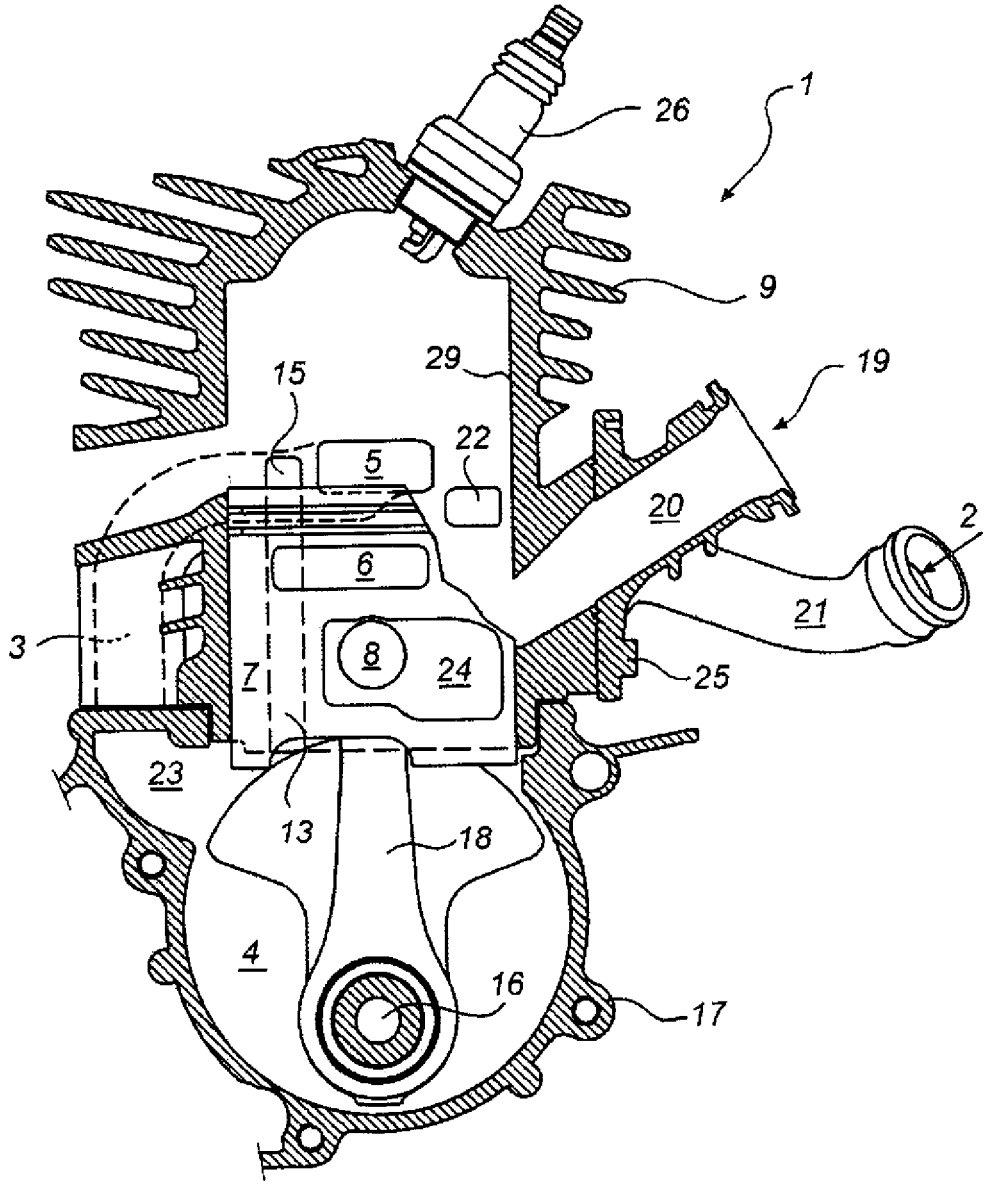
Figure 3:
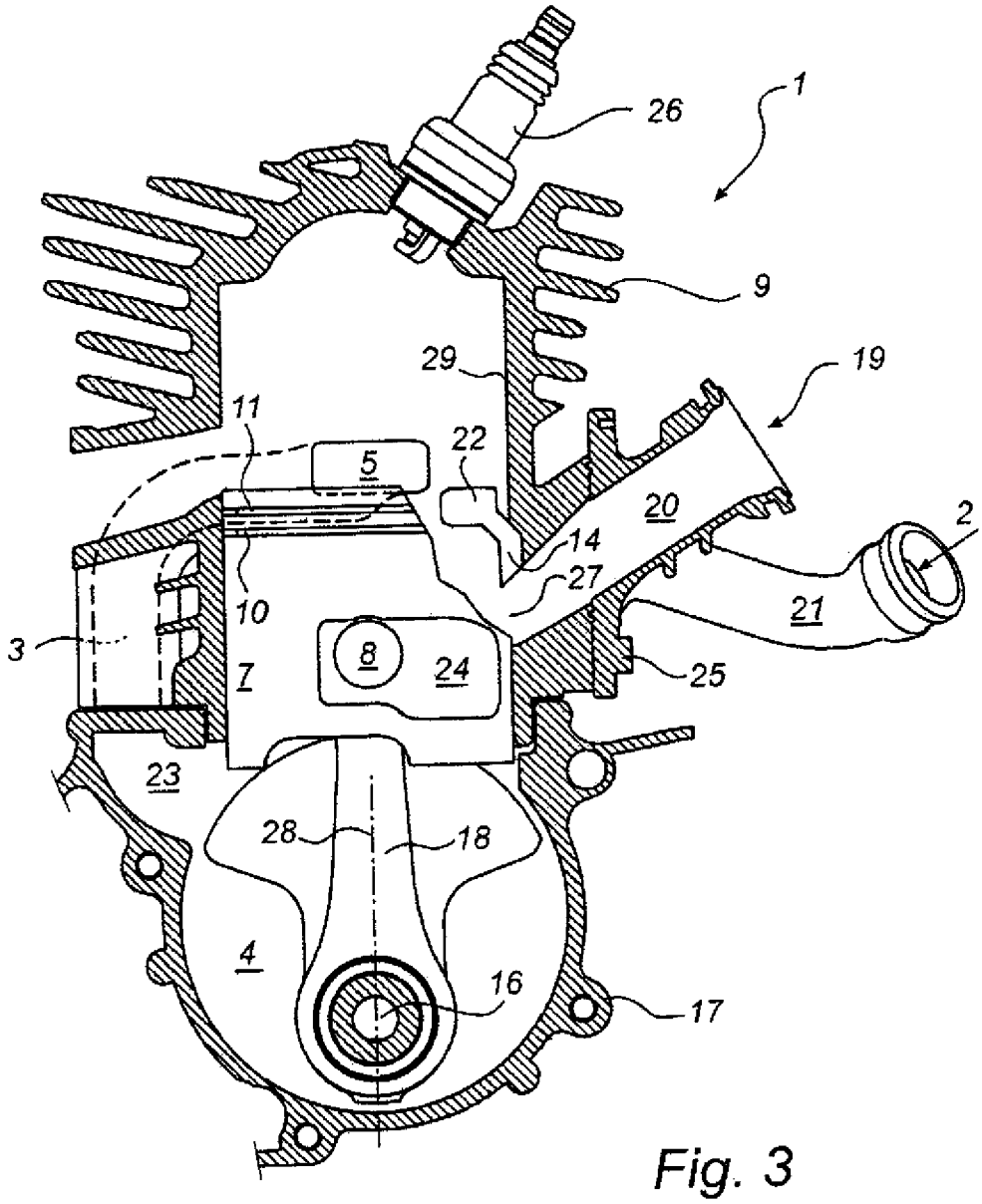

For this invention this operation is modified slightly. When the piston 7 moves upwards from the bottom dead center position, as shown in FIGS. 1, 2 and 3, a first recess 6 in the piston will come into register with the transfer port 5. The flow channel 12 in the form of at least one aperture 12 is arranged in the first recess 6. Therefore it connects the transfer port 5 with the interior of the piston 7, i.e. with the crankcase volume 4. The aperture 12 in the piston is preferably in the form of a single hole with diameter of more than 4 mm but less than 10 mm, and preferably more than 5 mm and less than 8 mm, or a single aperture with different shape but with a corresponding area. A center of the single aperture in the piston is transversally offset from a longitudinal center axis 28 of the piston and the cylinder bore running through the center of the crankshaft 16 of more than 2 mm but less than 15 mm and preferably more than 4 mm but less than 12 mm. Instead of a single aperture there can be two or more apertures, e.g. round or square holes, in the piston having a corresponding area as a round hole with a diameter of more than 4 but less than 10 millimeters.

The first recess in the piston is arranged in an upper region of the piston below a piston ring 10, 11. The offset position of the single aperture of the piston is a clear advantage as it enables the aperture 12 to be laterally to the side of the stiffening parts going longitudinally upside from the piston pin 8 to take the heavy loads from the piston pin.

It is also possible to make the flow channel or aperture 12 so that it also acts as a recess 6. It must then be located laterally in the piston, so that it will register with the transfer port for certain piston positions.

FIG. 2 shows a second embodiment of the invention. Here the flow channel 13 is arranged as an essentially longitudinal duct in the cylinder wall 14, which has at least an open end 15 located essentially laterally beside a transfer port 5. This means that the first recess 6 will register with both the open end 15 and the transfer port 5 for certain first piston positions. The flow channel 13 opens up in the crankcase volume below the piston in the cylinder wall or in the crankcase 17. This means that it communicates the transfer port with the crankcase volume. Usually the flow channel 13 is arranged to be open towards the cylinder wall in its entire length. Its length is greater than the height of the piston so that the flow channel 13 opens up for the flow below the piston. Usually this open flow channel 13 is formed by die-casting of a cylinder 9 and the flow channel has a shape of an open groove 13.

Both embodiments show an engine wherein the additional air supply 2 to the transfer ducts is arranged via an air duct 21 connected to the cylinder 9 and via the cylinder wall 14 leading to an air supply port 22 that is connected to the transfer port 5 via a recess 24 in the piston 7 for certain piston positions. The two embodiments show two different piston recesses 6, 24, a first recess 6 that is separate from and located above a second recess 24. When the piston is rising from the bottom dead center position shown the transfer port 5 will first register with the first recess 6 for certain first piston positions and later the transfer port 5 will register with the second recess for certain second piston positions. This is advantageous as the transfer duct 3 with port 5 will first be prepared during the first piston positions for the additional air supply that will take place during the second piston positions. However the same good effect can also be reached with a single recess 24 by making a connection between the two recesses 6,24, e.g. rising from the top left corner of former recess 24. In the two shown embodiments there are two air ducts 21 each leading to an air supply port 22. But there could also be a single air duct 21 and a branch in the cylinder wall so that the air branches off to the two different air supply ports 22.

The two shown embodiments are thus so called piston-ported engines considering the supply of additional air. This also applies to the third embodiment shown in FIG. 3. However the invention could also be used for engines having its additional air supplied directly to its transfer ducts 3 through check valves, also called Reed valves. Also in this case the feed of air would be improved by the invention giving an improved condition at different speeds for feeding of the additional air.

FIG. 3 shows an engine wherein the flow channel 14 is arranged in the cylinder wall 29 between an air supply port 22 and an intake port 27 at the surface of the cylinder bore. The flow channel 14 could also be arranged deeper down in the cylinder wall and/or in a connected intake system 19. Especially simple would be to arrange the flow channel as a depression in either or both of the meeting mounting planes between the cylinder and the intake system 19. All these options create a communication between the transfer port 5 and the crankcase volume via the piston recess 24, the air supply port 22, the flow channel 14, the intake port 27 and below the piston.

We claim:

1. A crankcase scavenged two-stroke internal combustion engine (1) having an additional air supply (2) arranged to its transfer ducts (3), each transfer duct having a transfer duct having a transfer port (5), which transfer ducts connect a crankcase volume (4) and a transfer port (5), and the additional air supply (2) to the transfer ducts (3) is arranged via an air duct (21) connected to the cylinder (9) and via the cylinder wall (29) leading to an air supply port (22) that is connected to the transfer port (5) via a first recess (24) in the piston (7) for certain first piston positions, characterized in that there is at least one second function recess (6, 24) in piston (7) arranged below a piston ring (10, 11) and further there is a flow channel (12; 13; 14) arranged in the piston or in a cylinder wall (29) of the engine cylinder (9), and the second recess is arranged to register with the transfer port (5) and the flow channel (12, 13, 14), the flow channel connecting the crankcase volume (4) with the second recess for certain piston positions, i.e. to create a communication between the transfer port/s and the crankcase volume.

2. An engine according to claim 1, wherein the flow channel (12) is arranged as an aperture (12) in the piston (7).

3. An engine according to claim 2, wherein the aperture in the piston is at least one round hole with a diameter of more than 4 but less than 10 millimeters, or at least one aperture with different shape than the round hole but with a corresponding area as a round hole with a diameter of more that 4 but less than 10 millimeters.

4. An engine according to claim 3, wherein the flow channel (12) also acts as recess (6) and is so located laterally in the piston that it will register with the transfer port (5), for certain piston positions.

5. An engine according to claim 1, wherein the flow channel (12) in the form of at least one aperture (12) is located within the first recess (6).

6. An engine according to claim 5, wherein the aperture in the piston is in the form of a single hole (12) with a diameter of more than 4 mm but less than 10 mm, and preferably more than 5 mm and less than 8 mm, or a single aperture with different shape but with a corresponding area.

7. An engine according to claim 6, wherein a center of the single aperture in the piston is transversally offset from a longitudinal center axis of the piston and cylinder running through the center of the crankshaft (16) of more than 2 mm but less than 15 mm and preferably more than 4 mm but less than 12 mm.

8. An engine according to claim 1, wherein the flow channel (13) is arranged as an essentially longitudinal duct in the cylinder wall (29), which has at least an open end (15) located essentially laterally beside the transfer port (5).

9. An engine according to claim 8, wherein the flow channel (13) is arranged to be open towards the cylinder wall (29) in its entire length.

10. An engine according to claim 9, wherein the cylinder (9) is formed by die-casting and the flow channel (13) has a shape of an open groove (13).

11. An engine according to claim 1, wherein the flow channel (14) is arranged in the cylinder wall (29) between an air supply port (22) and an intake port (27) at the surface of the cylinder bore or deeper down than the intake port (27) in the cylinder wall or in a connected intake system (19), creating a communication between the transfer port (5) and the crankcase volume via the piston recess (24), air supply port (22), the flow channel (14), the intake port (27) and below the piston (7).

* * * * *

UNITED STATES PATENT AND TRADEMARK OFFICE

CERTIFICATE OF CORRECTION

PATENT NO. : 7,634,980 B2
APPLICATION NO. : 11/571779
DATED : December 22, 2009
INVENTOR(S) : Per-Arne Jarnland, Stefan Steen and Joel Berneklev It is certified that error appears in the above-identified patent and that said Letters Patent is hereby corrected as shown below:

Delete Title Page, and replace with new Title Page. (attached)

Sheet 1 of 3, delete drawing page and insert drawing page 1/3 (attached)

Sheet 2 of 3, delete drawing page and insert drawing page 2/3 (attached)

Sheet 3 of 3, delete drawing page and insert drawing page 3/3 (attached)

Column 1, line 26, please delete “often” and insert therefor a space;

Column 2, line 62, please delete “, 2 and 3” and insert --and 2--;

Signed and Sealed this
Eighth Day of February, 2011

David J. Kappos

David J. Kappos
*Director of the United States Patent and Trademark Office*

(12) United States Patent
Jarnland et al.

(10) Patent No.: US 7,634,980 B2
(45) Date of Patent: Dec. 22, 2009

(54) CRANKCASE SCAVENGED TWO-STROKE INTERNAL COMBUSTION ENGINE HAVING AN ADDITIONAL AIR SUPPLY

(75) Inventors: Per-Arne Jarnland, Huskvarna (SE); Stefan Steen, Huskvarna (SE); Joel Berneklev, Hisings Backa (SE)

(73) Assignee: Husqvarna AB, Huskvarna (SE)

( * ) Notice: Subject to any disclaimer, the term of this patent is extended or adjusted under 35 U.S.C. 154(b) by 310 days.

(21) Appl. No.: 11/571,779

(22) PCT Filed: Jul. 16, 2004

(86) PCT No.: PCT/SE2004/001137

§ 371 (c)(1),
(2), (4) Date: Feb. 16, 2007

(87) PCT Pub. No.: WO2006/009494

PCT Pub. Date: Jan. 26, 2006

(65) Prior Publication Data

US 2008/0302345 A1 Dec. 11, 2008

(51) Int. Cl.
*F02B 25/00* (2006.01)
*F02B 33/04* (2006.01)

(52) U.S. Cl. ..... 123/73 R; 123/73 AA; 123/73 PP

(58) Field of Classification Search ..... 123/73 R, 123/73 AA, 73 PP
See application file for complete search history.

(56) References Cited

U.S. PATENT DOCUMENTS

| | | | | |
|---|---|---|---|---|
| 6,895,910 | B2 * | 5/2005 | Geyer et al. | 123/73 PP |
| 6,945,203 | B2 * | 9/2005 | Amend et al. | 123/73 PP |
| 2002/0043227 | A1 * | 4/2002 | Carlsson et al. | 123/73 PP |
| 2002/0112681 | A1 | 8/2002 | Rosskamp et al. | |
| 2003/0029398 | A1 * | 2/2003 | Andersson et al. | 123/73 PP |
| 2003/0217710 | A1 | 11/2003 | Geyer et al. | |

FOREIGN PATENT DOCUMENTS

| | | |
|---|---|---|
| EP | 1 006 267 A1 | 6/2000 |
| SE | 513466 C2 | 9/2000 |

* cited by examiner

*Primary Examiner*—Noah Kamen
(74) *Attorney, Agent, or Firm*—Pearne & Gordon LLP

(57) ABSTRACT

A crankcase scavenged two-stroke internal combustion engine (1) having an additional air supply (2) arranged to its transfer ducts (3), connecting a crankcase volume (4) and a transfer port (5). There is at least one recess (6, 24) in a piston (7) arranged below a piston ring (10, 11), and further there is a flow channel (12; 13; 14) arranged in the piston or in a cylinder wall (29) of the engine cylinder (9), and the recess is arranged to register with the transfer port and the flow channel for certain first piston positions, i.e. to create a communication between the transfer port/s and the crankcase volume.

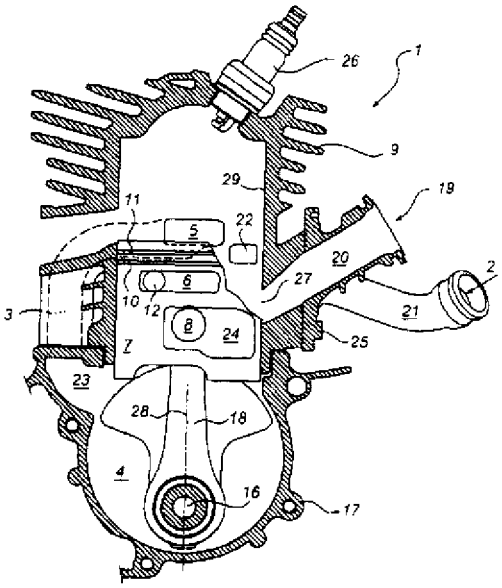

11 Claims, 3 Drawing Sheets